United States Patent [19]

Hartman et al.

[11] Patent Number: 5,071,096

[45] Date of Patent: Dec. 10, 1991

[54] DRINK CONTAINER STABILIZING DEVICE

[75] Inventors: Jerome Hartman, Carlisle; John E. Schenken; Charles A. Haas, both of Des Moines, all of Iowa

[73] Assignee: Cobbs Manufacturing Co., Des Moines, Iowa

[21] Appl. No.: 647,145

[22] Filed: Jan. 29, 1991

[51] Int. Cl.[5] ..... A47J 47/16

[52] U.S. Cl. ..... 248/154

[58] Field of Search ..... 248/146, 154, 310, 311.2, 248/313, 314; 220/85 H

[56] References Cited

U.S. PATENT DOCUMENTS

| | | | |
|---|---|---|---|
| D. 281,755 | 12/1985 | Bradley | D7/45 |
| 2,729,080 | 1/1956 | Bennett | 248/314 |
| 2,963,256 | 12/1960 | Borah | 248/314 |
| 3,028,702 | 4/1962 | St. Cyr | 45/68.4 |
| 3,096,960 | 7/1963 | Kinney | 248/314 |
| 3,312,436 | 4/1967 | Beghetto | 248/148 |
| 4,271,878 | 6/1981 | Bologa | 248/146 |
| 4,929,381 | 4/1990 | Buist | 248/311.2 |

*Primary Examiner*—Ramon O. Ramirez
*Assistant Examiner*—Robert A. Olson
*Attorney, Agent, or Firm*—Dick and Harris

[57] ABSTRACT

A drink container stabilizing device which normally rests upon a relatively horizontal surface for releasably holding various sized drink containers. One or more biased members, each of which are secured to the inner surface of a frame, releasably hold various sized drink containers within the frame's interior region. The frame has a top end and a bottom end which rests upon the relatively horizontal surface when the drink container stabilizing device is in a resting position. A retaining member may be used to further secure the one or more biased members proximate the top end of the frame, and a base plate may be attached to the bottom end of the frame so as to provide an underlying support for a drink container should the device be raised from its resting position. The base plate may further serve to secure the one or more biased members proximate to the bottom end of the frame.

19 Claims, 2 Drawing Sheets

Fig 5
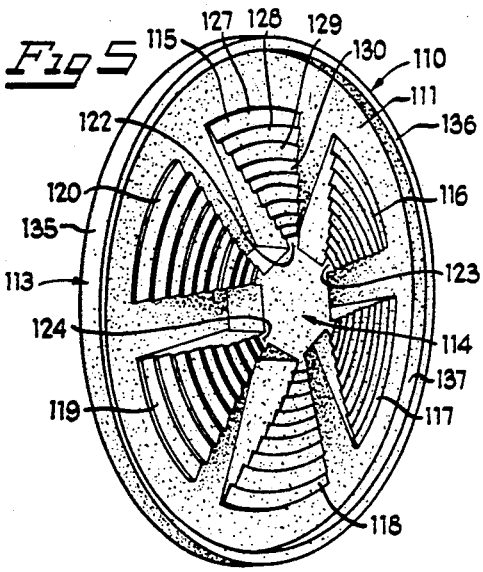
Fig 10
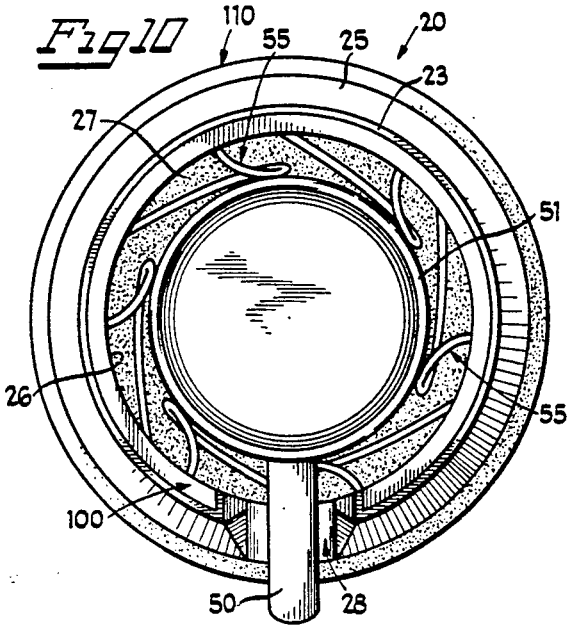
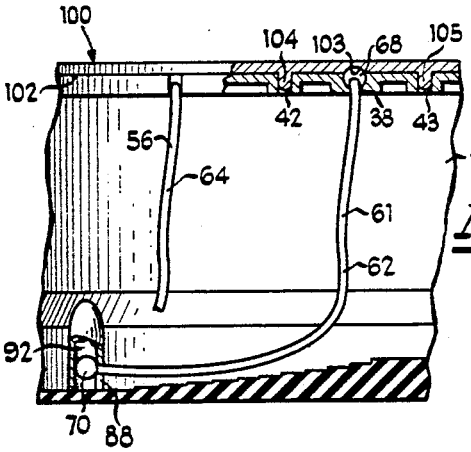
Fig 6
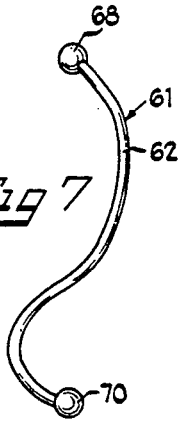
Fig 7
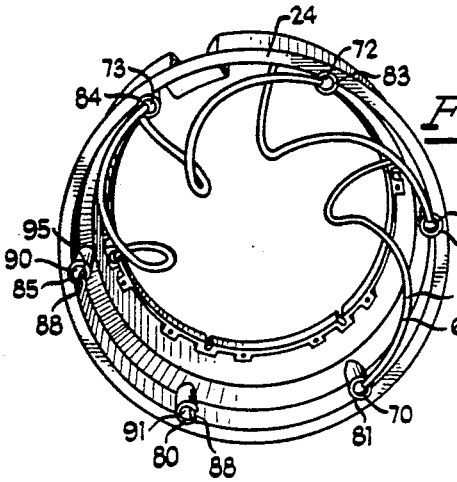
Fig 8
Fig 9
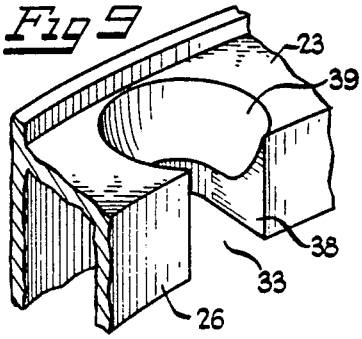

DRINK CONTAINER STABILIZING DEVICE

BACKGROUND OF THE INVENTION

1. Field of the Invention

This invention relates generally to drink container holders and stabilizers and more particularly to drink container holders which can releasably hold and stabilize drink containers having various longitudinal and transverse cross-sectional areas.

2. Background Art

Drink container holders, of the type primarily intended for use within a motor vehicle, have been around for many years. While such drink holders have primarily been intended to prevent a drink container from tipping over, or spilling, when exposed to vibrations and other occurrences which typically result when a vehicle is in motion, such drink holders have been limited for use with only a few different sizes of drink containers. One example of such prior art drink container holders comprises a flexible pouch that surrounds a relatively rigid styrofoam cup capable of receiving a beverage can; the space between the styrofoam cup and the flexible pouch is partially filled with particulate matter.

The drink container or can itself is held in that prior art device by a plastic ring having a plurality of short finger-like elements attached adjacent the top end of the styrofoam cup or holder. These finger-like elements provide only limited expansion and are intended for securement of drink containers, such as beverage cans, having diameters only slightly smaller than the diameter of the top end of the holder to which the plastic ring is attached. The drink containers themselves are then placed between the finger-like elements and pushed toward the bottom of the holder. Unfortunately, these finger-like elements of the plastic ring form a relatively defined diameter which only allows for marginal expansion when inserting a drink container. Accordingly, this limited ability to expand severely restricts the sizes of drink containers which can adequately be held within the drink container holder. Furthermore, such prior art devices do not readily accommodate a drink container having a handle, such as a coffee mug.

SUMMARY OF THE INVENTION

The present invention is concerned with providing a drink container stabilizing device for use in adequately holding and stabilizing drink containers having various transverse and longitudinal cross-sectional areas. One or more biased members, each having a first end and an opposite second end provide the means for releasably holding the drink container in the interior region of the frame. Elongated strands may form the biased members and be so configured that when attached to the frame they define an elastically deformable inner framework with a transverse cross-section which decreases from adjacent the top end to an intermediate portion. The biased members, or strands, have their first ends attached proximate the top end of the frame, and their second ends attached proximate the bottom end of the frame. These biased members, may be secured proximate the top of the frame by a retaining member which securely fits over the top ends of the strands, and is attached to the top end of the frame itself. The bottom end of the frame can include a base plate which provides an underlying support to the drink container when housed within the interior region of the frame, as well as serving to preclude detachment of the second, or bottom ends of the strand members when the device is raised from a substantially horizontal plane, when securing a drink container within the interior region of the frame.

BRIEF DESCRIPTION OF THE DRAWINGS

For a better understanding of the present invention, reference may be had to the accompanying drawings in which:

FIG. 5 is an enlarged scale perspective view of the drink container contact side of the base plate;

FIG. 6 is a fragmentary cross-sectional view taken generally along line 6—6 of FIG. 3 with part of the top end broken away;

FIG. 7 is an enlarged scale perspective view of one of the strand members;

FIG. 8 is a bottom perspective view of the frame means with some of the strand members inserted;

FIG. 9 is an enlarged scale fragmentary view taken generally along line 9—9 of FIG. 2; and FIG. 10 is a top plan view of the embodiment of the present invention holding a drink container.

DETAILED DESCRIPTION OF THE DRAWINGS

Figure 1:
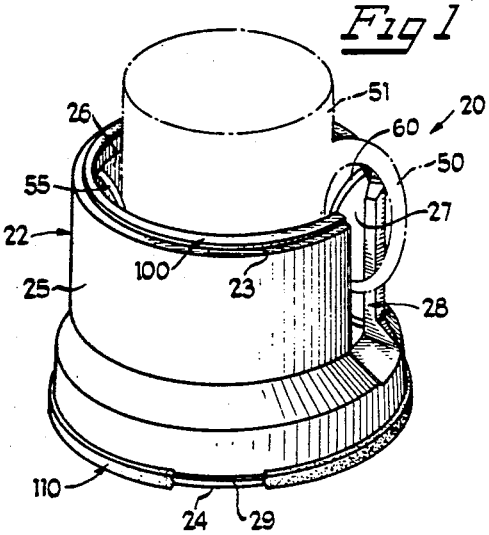
FIG. 1 is a perspective view of the embodiment of the present invention shown holding a drink container.

While this invention is susceptible of embodiment in many different forms, there is shown in the drawings and will herein be described in detail, several specific embodiments with the understanding that the present disclosure is to be considered as an exemplification of the principles of the invention and is not intended to limit the invention to the embodiments illustrated.

Drink container stabilizing device 20 is shown in FIG. 1 as comprising frame means 22, releasable holding means 55, retaining member 100 and underlying support means 110. Frame means 22 includes top end 23, bottom end 24, which is better shown in FIG. 8, outer surface 25, inner surface 26, interior region 27 and drink container handle extension means 28. Drink container handle extension means 28 enables a handle 50 of a mug 51 or the like, to extend beyond outer surface 25 of frame means 22, as is additionally shown in FIG. 10.

Figure 2:
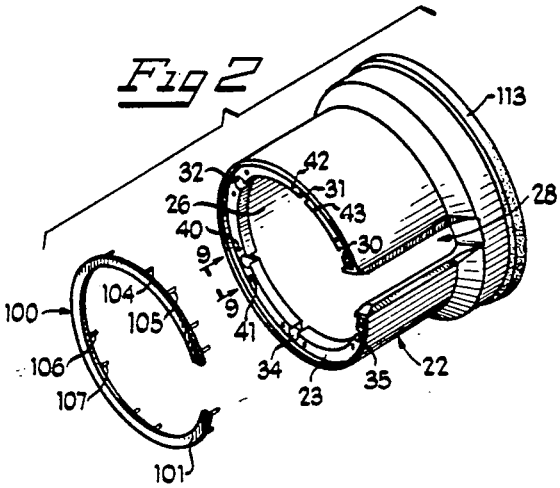
FIG. 2 is a partial, exploded view of the top retaining member and the frame means.

As shown in greater detail in FIG. 2, top end 23 of frame means 22 includes top receiving slots 30 through 35 and retaining member attachment apertures, such as retaining member attachment apertures 40 through 43. Each of the top receiving slots 30 through 35, comprise slit portions, such as slit portion 38, and strand end seats, such as strand end seat 39, as shown in greater detail in FIG. 6 and FIG. 9. Bottom end 24, as shown in FIG. 8, comprises bottom receiving slots 80 through 85, and base plate accepting lip 29 which receivably cooperate with base plate 110. Each bottom receiving slot 80 through 85 includes slit portions, such as slit portion 88, strand end accepting channels, such as strand end accepting channels 90 through 92, and stop means, such as stop means 95, which serve to prevent over insertion of securement means 55 into a respective bottom receiving slot, as shown in FIG. 8. The cooperation between the top and bottom receiving slots with releasable holding means 55 will be explained in greater detail in FIGS. 6 through 9.

Figure 3:
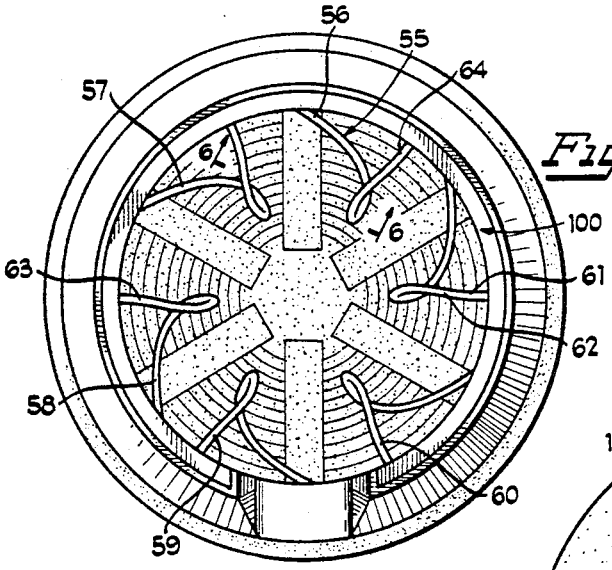
FIG. 3 is an enlarged scale top plan view of the embodiment of the present invention.

Mug 51, or any other type of drink container having a diameter slightly smaller than the diameter of interior region 27 of frame means 22, as shown in FIG. 1 and FIG. 10, is releasably held within interior region 27 of frame means 22 by releasable holding means 55. Releasable holding means 55 comprises a plurality of elongated strand members 56 through 61, as shown in FIG. 3. Each strand member has a shaft, such as shafts 62 through 64, a top end, such as top end 68, and a bottom end, such as bottom ends 70 through 73, as shown in FIG. 6 and FIG. 8. The top end and the bottom end of each strand member has an enlarged portion of a substantially spherical configuration. As can be seen in greater detail in FIG. 3 and FIG. 10, strand members 56 through 61, which are preferably constructed from a resilient material, are compressible upon insertion of a drink container, such as drink container 51, into the inner framework defined by the strands, and within interior region 27 of frame means 22. One type of material which can be used for the strand members is acetell, due to its relatively high melting point and low coefficient of friction, although other materials are also contemplated.

Such compressibility of the strand members facilitates acceptance of drink containers having various transverse and longitudinal dimensions, providing, of course, that the transverse dimension of the drink container does not exceed the transverse dimension of interior region 27 of frame means 22. Each of strand members 56 through 61 is made in a predetermined configuration, as is best illustrated in FIG. 7, in order to define elastically deformable inner framework so that in its substantially uncompressed, undeformed condition the framework has a cross-section which decreases from adjacent top end 23 toward an intermediate portion forming a funnel-like upper part, as is best illustrated in FIGS. 3 and 8, to further facilitate the insertion and acceptance of drink containers. As illustrated in FIG. 3 and FIG. 8, prior to insertion of a drink container, such as drink container 51, between strand members 56 through 61, such stand members will be in a substantially uncompressed, undeformed condition. However, as drink container 51 is inserted into the framework defined by the strands in interior region 27 of frame means 22, and pushed downward between the strands, each strand member 56 through 61 will, while remaining in partial contact with the outer surface of the drink container, compress towards inner surface 26 of frame means 22. Accordingly, due to the biased nature of resilient strand members 56 through 61, a drink container, such as drink container 51, will be readily accepted and held between, and easily released from strand members 56 through 61.

Top ends, such as top end 68, of strand members 56 through 61, as shown in FIG. 3 and FIG. 6, are secured within top receiving slots 30 through 35 as shown in FIG. 2, by retaining member 100. Retaining member 100 comprises top side 101, frame contact side 102, shown in FIG. 6, grooves, such as groove 103, shown in greater detail in FIG. 6, and retaining posts, such as retaining posts 104 through 107. The retaining posts are inserted into corresponding retaining member attachment apertures, such as retaining member attachment apertures 40 through 43 respectively, and are held by an interference fit. Accordingly, inasmuch as top ends, such as top end 68, as shown in FIG. 6, of strand members, such as strand member 61, protrude slightly above top end 23 of frame means 22 when completely seated within a respective top receiving slot, such as top receiving slot 31, the groove, such as groove 103 located on the underside of retaining member 100, enables a substantially flush fit between the frame contact side of retaining member 100, and top end 23 of frame means 22.

Actual securing of strand members 56 through 61 to frame means 22 is shown in FIGS. 6 through 9. Such attachment may result by inserting shafts, such as shaft 62, of strand members, such as stand member 61, proximate their top ends, such as top end 68, through slit portions, such as slit portion 38, of top receiving slots, such as top receiving slot 31, so that top end 68 is positioned above top surface 23 of frame means 22. Strand member 61 is then released so that top end 68 can be properly positioned within strand end seats, such as strand end seat 39. Once top end 68 is properly seated, bottom end, such as bottom end 70, of strand members, such as strand member 61, is inserted in similar fashion within bottom receiving slots such as bottom receiving slot 81. When the bottom ends of the strand members are properly inserted, they will be completely immersed within the bottom receiving slots, and will not protrude external to bottom surface 24 of frame means 22. Furthermore, strand members 56 through 61 will be precluded from over insertion into bottom receiving slots 80 through 85 as the result of stop means, such as stop means 95, which are positioned above each of the bottom slits. These stop means actually comprise the tops of the slits themselves.

Figure 4:
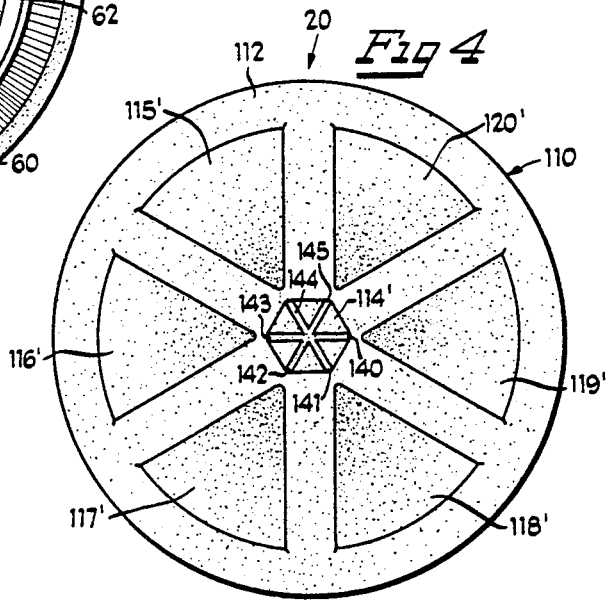
FIG. 4 is an enlarged scale bottom plan view of the embodiment of the present invention.

Base plate 110 is shown in detail in FIG. 4 and FIG. 5 as including drink contact surface 111, bottom surface 112, attachment lip 113 and center portion 114. Drink contact surface 111, is shown as having a plurality of wedge-like members 115 through 120 which each comprise levels of ascending steps, such as ascending steps 127 through 130, which ascend towards center portion 114 Wedge-like members 115 through 120 have their respective apexes, such as apexes 122 through 124, abut with center portion 114 of base plate 110. Inasmuch as each of the levels of ascending steps are substantially parallel to each higher or lower level and, positioned at a relatively horizontal angle, it is intended that the bottom of various drink containers abut with one of the levels of steps so as to increase the surface of contact between the drink container and drink contact surface 111 of base plate 110, thereby increasing stability to, and reducing inadvertent movement of, the drink container, when apparatus 20 is exposed to normal vibration which may result when apparatus 20 is resting within a moving vehicle.

Bottom surface 112 of base plate 110, is shown as having the underside of wedge-like members 115′ through 120′ and the underside of center portion 114′. As can be seen, underside of center portion 114′ has a plurality of support members 140 through 145 which serve to define inverted, substantially hollow triangular segments. These support members provide rigidity to center portion 114.

Attachment lip 113, which is integrally formed along the peripheral edge of base plate 110, includes outer peripheral edge 135, top edge 136, and inner wall 137. Top edge 136, is cantilevered over drink contact surface 111, so that inner wall 137 is substantially recessed with respect to the cantilevered portion of top edge 136.

Accordingly, this results in a lip-like configuration which cooperates with accepting lip 29 of frame means 22, as shown in FIG. 1, so as to removably attach base plate 110 to frame means 22. In addition, it is preferred that base plate 110 be constructed from a material having a relatively high coefficient of friction so as to reduce the amount of movement by a drink container, (such as drink container 51), which is resting upon base plate 110 and positioned within interior region 27 of frame means 22. One type of material which has been contemplated for base plate 110 is an elastomer produced by Monsanto Corporation which is sold under the trademark BYRAM.

The foregoing description and drawings merely explain and illustrate the invention and the invention is not limited thereto accept in so far as the appended claims are so limited, as those skilled in the art who have the disclosure before them will be able to make modifications and variations therein without departing from the scope of the invention.

What is claimed is:

1. A drink container stabilizing device which rests upon a relatively horizontal surface for releasably holding a drink container which may have various longitudinal and transverse dimensions, said drink container stabilizing device comprising:

means for providing a frame around at least a portion of a drink container, the frame means having a bottom end located adjacent to said relatively horizontal surface when the drink container stabilizing device is in a resting position, a top end opposite the bottom end, an outer surface, an inner surface and an interior region positioned adjacent the inner surface;

means for releasably holding a drink container in the interior region of the frame means, the holding means including one or more biased members each of which have a first end and a second end opposite the first end, wherein the first end is positioned proximate to the top end of the frame means, and the second end is positioned proximate to the bottom end of the frame means; and means for securing the holding means to the frame means.

2. The invention according to claim 1 in which each of the one or more biased members comprise elongated strand members.

3. The invention according to claim 1 in which the frame means further includes means for enabling a handle of a drink container to extend external of the outer surface of the frame means when the drink container is positioned within the interior region of the frame means;

the drink container handle extension means comprises an opening through a portion of the outer surface and inner surface of the frame means wherein said opening extends between and substantially adjacent to said top and bottom ends of said frame means.

4. The invention according to claim 1 in which the drink container stabilizing device further includes means for providing an underlying support to the frame means when the drink container stabilizing device is removed from the relatively horizontal surface it was resting on, the support means being attached adjacent to the bottom side of the frame means.

5. The invention according to claim 4 in which the support means is constructed from a material having a relatively high coefficient of friction.

6. A drink container stabilizing device which rests upon a relatively horizontal surface for releasably holding a drink container which may have various longitudinal and transverse dimensions, said drink container stabilizing device comprising:

means for providing a frame around at least a portion of a drink container, the frame means having a bottom end located adjacent to said relatively horizontal surface when the drink container stabilizing device is in a resting position, a top end opposite the bottom end, an outer surface, an inner surface and an interior region positioned adjacent the inner surface;

means for releasably holding a drink container in the interior region of the frame means, the holding means including one or more biased members each of which have a first end and a second end opposite the first end, wherein the first end is positioned proximate to the top end of the frame means, and the second end is positioned proximate to the bottom end of the frame means;

means for securing the holding means to the frame means;

the drink container stabilizing device further includes means for providing an underlying support to the frame means when the drink container stabilizing device is removed from the relatively horizontal surface it was resting on, the support means being attached adjacent to the bottom side of the frame means, the support means is constructed from a material having a relatively high coefficient of friction, and the support means including a base plate having a drink container contact side substantially exposed to the interior region of the frame means, a bottom surface opposite the drink container contact side, and a center section.

7. The invention according to claim 6 in which a portion of the drink container contact side of the base plate slopes upwardly toward the center section of the base plate so as to increase stability and reduce inadvertent movement of the drink container held within the interior region of the frame means.

8. The invention according to claim 7 in which the base plate includes a plurality of spaced apart levels of ascending steps, for further reducing the inadvertent movement of the drink container held within the interior region of the frame means, each of the levels of steps ascending upward toward the center section of the base plate.

9. The invention according to claim 8 in which the sloped portion of the base plate comprises a plurality of wedge shaped segments wherein the apexes of each of the wedge shaped segments abut with the center section of the base plate.

10. The invention according to claim 6 in which the base plate further includes means for removal from the frame means.

11. The invention according to claim 10 in which the removal means includes an attachment lip which substantially conforms around a portion of the bottom end of the outer surface of the frame means, the attachment lip being integrally formed along the periphery of the base plate and extending upwardly from the drink container contact side.

12. A drink container stabilizing device which rests upon a relatively horizontal surface for releasably holding a drink container which may have various longitudinal and transverse dimensions, said drink container stabilizing device comprising:

means for providing a frame around at least a portion of a drink container, the frame means having a bottom end located adjacent to said relatively horizontal surface when the drink container stabilizing device is in a resting position, a top end opposite the bottom end, an outer surface, an inner surface and an interior region positioned adjacent the inner surface;

means for releasably holding a drink container in the interior region of the frame means, the holding means including one or more biased members each of which have a first end and a second end opposite the first end, wherein the first end is positioned proximate to the top end of the frame means, and the second end is positioned proximate to the bottom end of the frame means;

means for securing the holding means to the frame means, the securing means including one or more top accepting slots integrally positioned within the top end of the frame means, and one or more bottom accepting slots integrally positioned within the bottom end of the frame means for securing the one or more biased members to the frame means, and the first end of each of said one or more biased members each being positionable within a respective one of the one or more top receiving slots, and the second end of each of said one or more biased members each being positionable within a respective one of the one or more bottom accepting slots.

13. The invention according to claim 12 in which the number of the one or more top receiving slots and the number of the one or more bottom receiving slots correspond to the number of the one or more biased members attached to the frame means.

14. The invention according to claim 13 in which each of said one or more biased members comprise elongated strands each of which have an enlarged portion at the first end for receipt by the top receiving slots, and an enlarged portion at the second end for receipt by the bottom receiving slots.

15. The invention according to claim 14 in which each of the one or more strand members has a predetermined configuration so that when each of the one or more strand members are attached to the frame means, they define an elastically deformable framework with a transverse interior cross-section which decreases from adjacent the top end of the frame means toward an intermediate portion of the interior region of the frame means.

16. The invention according to claim 14 in which the enlarged portion of the first and second ends of each of the one or more stand members have a substantially spherical configuration.

17. The invention according to claim 14 in which the one or more top receiving slots each comprise a top slit portion and a strand end seat; and each of the one or more bottom receiving slots comprise a bottom slit portion, a strand end accepting channel and stop means to preclude over insertion of the bottom end of each of the one or more bottom strands within the receiving channel.

18. The drink container stabilizing device according to claim 17 in which the securing means further includes a removable retaining member attached to the top end of the frame means for precluding the inadvertent release of each of the one or more biased members from their respective one or more top receiving slots.

19. A drink container stabilizing device which rests upon a relatively horizontal surface for releasably holding a drink container which may have various longitudinal and transverse dimensions, said drink container stabilizing device comprising:

means for providing a frame around at least a portion of a drink container, the frame means having a bottom end located adjacent to said relatively horizontal surface when the drink container stabilizing device is in a resting position, a top end opposite the bottom end, an outer surface, an inner surface and an interior region positioned adjacent the inner surface;

means for releasably holding a drink container in the interior region of the frame means, the holding means including one or more biased members each of which have a first end and a second end opposite the first end, wherein the first end is positioned proximate to the top end of the frame means, and the second end is positioned proximate to the bottom end of the frame means;

means for securing the holding means to the frame means;

each of the one or more biased members including elongated strand members, and each of the one or more strand members having a predetermined configuration so that when each of the one or more strand members are secured to the frame means, they define an elastically deformable inner framework with a transverse cross-section which decreases from adjacent the top end of the frame means toward an intermediate portion of the interior region of the frame means.

* * * * *

UNITED STATES PATENT AND TRADEMARK OFFICE

CERTIFICATE OF CORRECTION

PATENT NO. : 5,071,096

DATED : December 10,1991

INVENTOR(S) : Jerome Hartmann et al.

It is certified that error appears in the above-identified patent and that said Letters Patent is hereby corrected as shown below:

| | |
|---|---|
| Col. 4 Line 41 | Delete "114 Wedge" and insert instead -- 114. Wedge --. |
| Col. 8 Line 5 | Delete "stand members" and insert instead -- strand members --. |

Signed and Sealed this

Sixth Day of April, 1993

*Attest:*

STEPHEN G. KUNIN

*Attesting Officer*

*Acting Commissioner of Patents and Trademarks*